US005129524A

United States Patent [19]

Holman

[11] Patent Number: 5,129,524

[45] Date of Patent: Jul. 14, 1992

[54] HOLDER FOR MULTIPLE STRING SUSPENDED TEA BAGS

[76] Inventor: Norman W. Holman, Midtown Professional Bldg., Ste. 2-B, 14 W. Jordan St., Pensacola, Fla. 32501

[21] Appl. No.: 592,197

[22] Filed: Oct. 3, 1990

[51] Int. Cl.[5] ..... A47F 7/00

[52] U.S. Cl. ..... 211/113; 211/123; 99/321; 99/322; 99/323

[58] Field of Search ..... 211/123, 65, 66, 113; 99/279, 323, 321, 322; 248/110, 111

[56] References Cited

U.S. PATENT DOCUMENTS

| | | | |
|---|---|---|---|
| 147,828 | 2/1874 | DeBoucherville | 188/65.4 |
| 191,125 | 5/1877 | Ewing . | |
| 285,159 | 9/1883 | Reynolds | 211/113 X |
| 289,050 | 11/1883 | Wilcox | 188/65.3 |
| 346,914 | 8/1886 | Henderson | 99/332 X |
| 386,237 | 7/1888 | Budd | 188/65.4 |
| 536,866 | 4/1895 | Fitz Gerald . | |
| 656,507 | 8/1900 | Brown . | |
| 771,251 | 10/1904 | Howe | 188/65.4 |
| 946,588 | 1/1910 | Thuener . | |
| 1,002,376 | 9/1911 | Doty | 99/321 |
| 1,115,603 | 11/1914 | Smith | 188/65.4 |
| 1,187,754 | 6/1916 | Da Costa Lyra | 188/65.5 |
| 1,693,974 | 12/1928 | Bienstock | 99/321 X |
| 1,728,381 | 9/1929 | Waters | 99/321 X |
| 1,785,878 | 12/1930 | Schachter | 99/322 X |
| 2,436,924 | 3/1948 | Hensen | 211/65 |
| 2,702,640 | 2/1955 | Leonard | 211/65 |
| 2,852,144 | 9/1958 | Reno | 211/65 |
| 3,087,584 | 4/1963 | Jackson et al. | 188/1 |
| 3,197,204 | 7/1965 | Holkesvick et al. | 272/133 |
| 3,220,511 | 11/1965 | Holkesvick | 188/65.4 |
| 3,250,515 | 5/1966 | Hudnall et al. | 254/156 |
| 3,268,088 | 8/1966 | Lawhorn | 211/13 |
| 3,517,604 | 6/1970 | Coors | 99/323 |
| 3,532,189 | 10/1970 | Wade | 188/65.3 |
| 3,550,726 | 12/1970 | Chezem et al. | 188/65.4 |
| 4,226,305 | 10/1980 | Frestad | 188/65.2 |
| 4,311,218 | 1/1982 | Steffen | 188/65.4 |
| 4,474,262 | 10/1984 | Himmelrich | 182/5 |
| 4,550,801 | 11/1985 | Forrest | 182/7 |
| 4,883,146 | 11/1989 | Varner et al. | 182/5 |

FOREIGN PATENT DOCUMENTS

| | | | |
|---|---|---|---|
| 0116016 | 8/1929 | Austria | 99/321 |
| 0001035 | 1/1913 | United Kingdom | 99/322 |
| 0204855 | 10/1923 | United Kingdom | 99/322 |
| 1315887 | 5/1973 | United Kingdom | 211/113 |

*Primary Examiner*—Robert W. Gibson, Jr.
*Attorney, Agent, or Firm*—Ira M. Adler

[57] ABSTRACT

The invention is a holder for multiple string suspended tea bags. In its preferred embodiment, it consists of a rigid rod, the end of which is concentrically encased in an end cap, and kept in place with an end cap holder. A plurality of spring means are suspended from the rod by means of tabs attached and secured to the rod. The tabs are kept separated by washer-like spacers and end spacers concentrically placed around the rod. Tea bag strings and tea bags are held vertically suspended in hot water for brewing.

In other embodiments of the invention, the rod is replaced with a T-shaped beam from which a tab-spring means may be suspended or which has a plurality of notches along its upper edge to hold the tea bag string and tea bag.

In different embodiments of the invention the rod or beam in a horizontal position may either be placed on the other rim of a cup or vessel or attached at opposite sides of the underneath of a vessel cover.

5 Claims, 5 Drawing Sheets

HOLDER FOR MULTIPLE STRING SUSPENDED TEA BAGS

BACKGROUND

1. Field of the Invention

The invention relates to a holder for multiple string suspended tea bags.

2. Description of Prior Art

It is often desirable to brew either large quantities of tea or tea of variable strengths. To accomplish this, it is necessary to vary the number of tea bags placed in the boiling water and to keep them separated. Placing several stringed tea bags unaided in a cup or a vessel results in the tangling of the strings. As the tea bags must be removed individually, the brew strength of the tea can vary considerably and it is possible to burn one's fingers in the hot water, or lose the string in the water. Further, it is desirable that the tea bag holder be easily transportable.

Previous tea bag holders only allowed for one tea bag to be brewed at a time or required the use of specially designed vessels. U.S. Pat. No. 4,602,557 discloses a cup with a notch on its rim. A specially designed cup is required. In its preferred embodiment, the present invention can be transported by the user and used in connection with any cup or other tea brewing vessel. U.S. pat. No. 4,619,830, which discloses a beverage filter unit and support discloses the use of a pouch-like tea holder, but is not compatible with conventional tea bags. Neither invention discloses its use with multiple tea bags.

SUMMARY OF THE INVENTION

The invention provides a tea bag holder for suspending a plurality of tea bags simultaneously over a cup or other vessel. A rod or T-shaped beam resting upon two opposite points on the rim of the cup or vessel contains a plurality if spring clips or notches for holding the tea bag strings. An advertising logo can be affixed to either or both faces of the T-shaped beam.

In an alternate embodiment of the invention a rod or T-shaped beam is attached at opposite points on the underneath outer rim of the lid of a pot or vessel.

DETAILED DESCRIPTION

Figure 1:
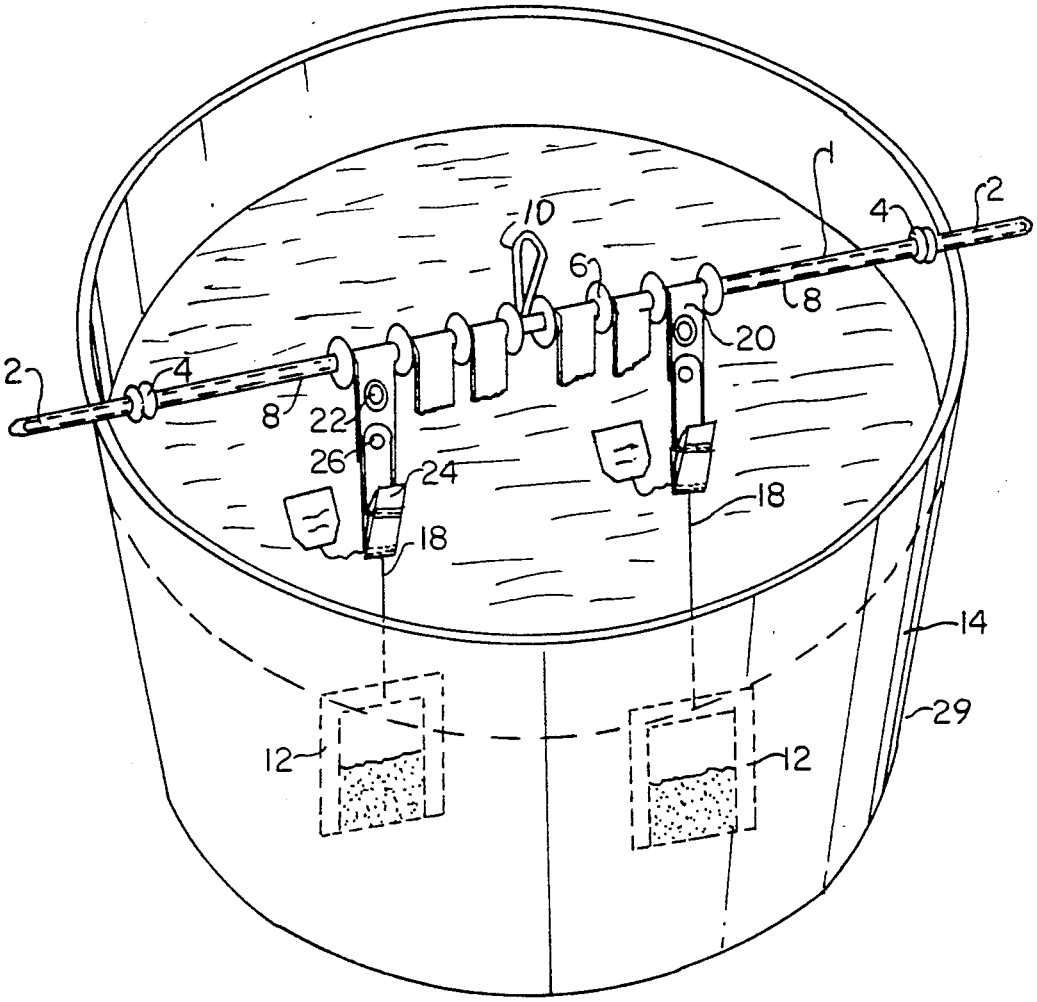
FIG. 1 is a perspective view of a preferred embodiment of the holder for multiple string suspended tea bags shown supported by a cup or vessel.

The preferred embodiment of the holder for multiple string suspended tea bags, as shown in FIG. 1, consists of a horizontally placed rigid rod 1, each end of which is encased with an end cap 2. An end cap holder 4 is tightly fitted against the inward end of the end caps. A plurality of tabs 20 are hung vertically over the central portion of the rod and fastened 22 under the rod. A vertically hanging spring clip mechanism 24 is attached 26 to the lower end of the tabs. A washer-like spacer 6 is concentrically fitted over the rod, on both sides of the tabs. The spacers permit easy movement of the tabs. Tubular end spacers 8, which limit lateral movement of the elements along the rod, are concentrically fitted over the rod. A suspension means 10 is centrally fitted around the rod and between the two innermost spacers. The suspension means permits the tea bag holder to be removed tea without potentially emerging one's fingers in hot water.

The tea bag holder is placed over a cup or vessel 29 by resting the end caps upon opposite sites on the rim of the cup or vessel. The strings 18 of the tea bags 12 are secured by the spring clip mechanisms, such that the tea bags are suspended in hot water 14 for brewing purposes.

Figure 2:
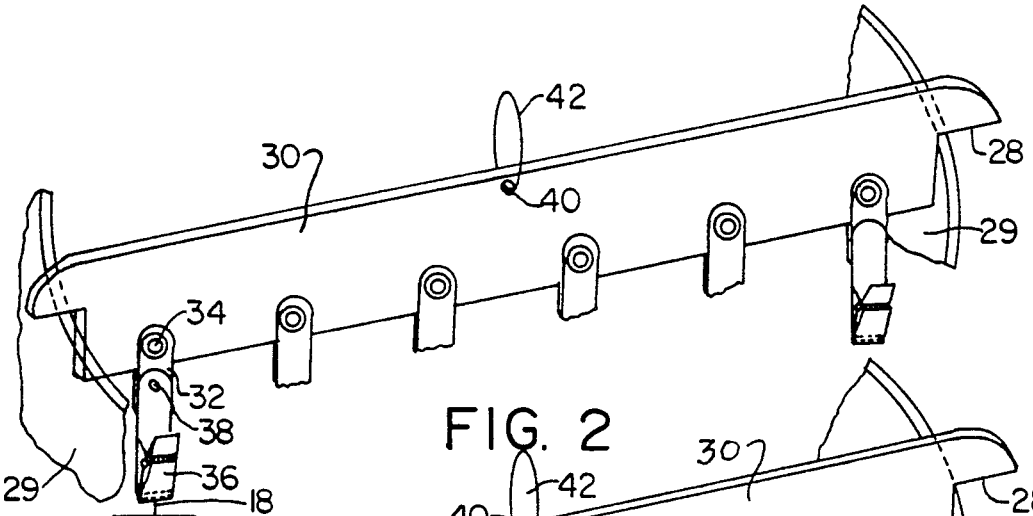
FIG. 2 is a perspective view of an alternative embodiment of the holder for multiple string suspended tea bags, using a spring means attached to a T-shaped beam to hold the tea bags.
Figure 2A:
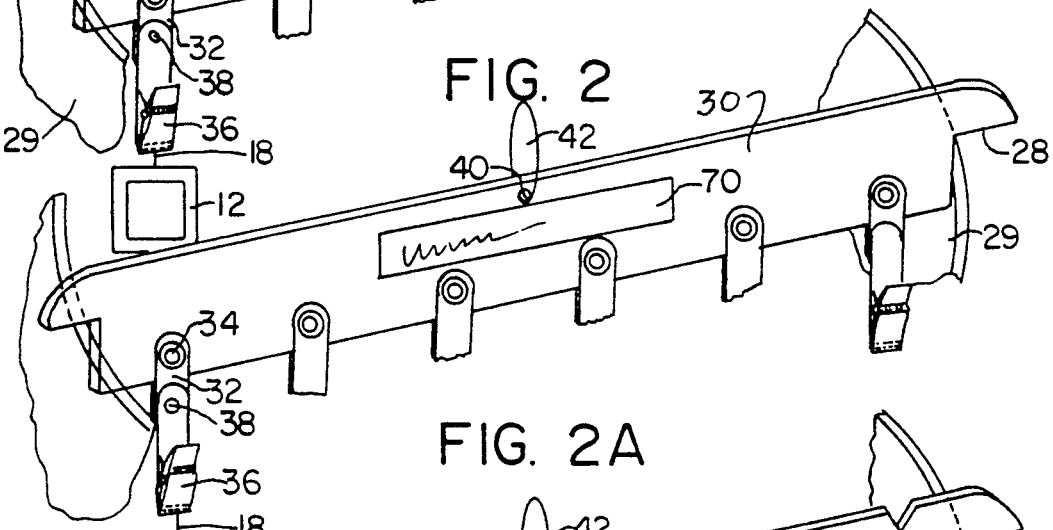
FIG. 2A is a perspective view of an alternative embodiment of the holder for multiple string suspended tea bags, using a spring means attached to a T-shaped beam to hold the tea bags, and with a logo affixed to either or both faces of the T-shaped beam.

In an alternative embodiment of the invention, FIG. 2, the rod is replaced by a horizontally placed T-shaped rigid beam 30. A plurality of tabs 32 are suspended vertically from the beam, being attached 34 to the said beam. A spring clip mechanism 36 is attached 38 to the lower end of the tabs.

Similarly to the preferred embodiment, the holder for multiple string suspended tea bags is placed over a cup or vessel 29 by resting the ends 28 upon opposite sites on the rim of the cup or vessel. Because the center of gravity of the beam is below the top of the rim of the vessel or cup, the tea bag holder is stable when in a resting position. The strings 18 of the tea bags 12 are secured by the spring clip mechanisms, such that the tea bags are suspended in hot water for brewing purposes. A suspension means 42 is fitted through a hole 40 in the upper part of the beam, for each lifting.

Figure 3:
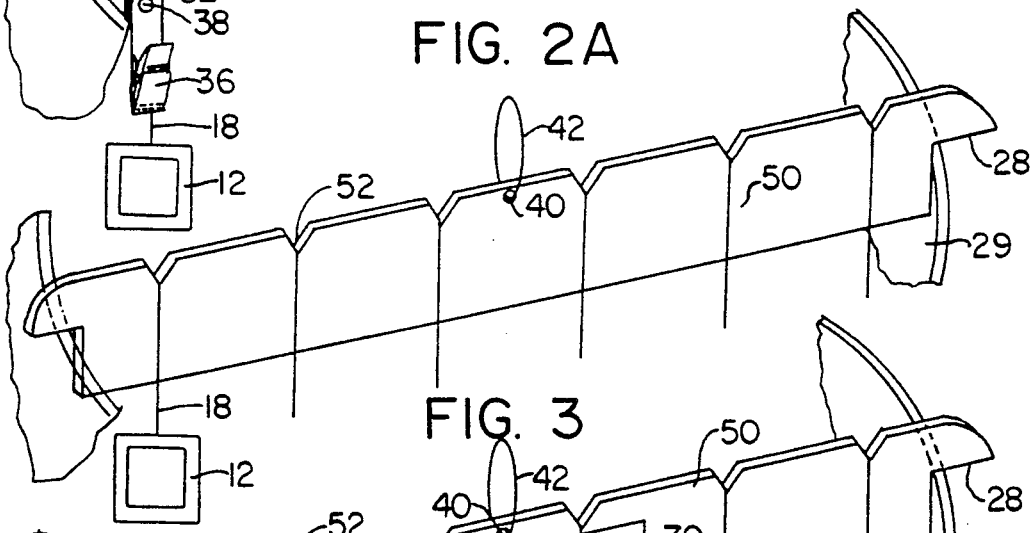
FIG. 3 is a perspective view of an alternative embodiment of the holder for multiple string suspended tea bags, using a notch means on the upper edge of a T-shaped beam to hold the tea bags.
Figure 3A:
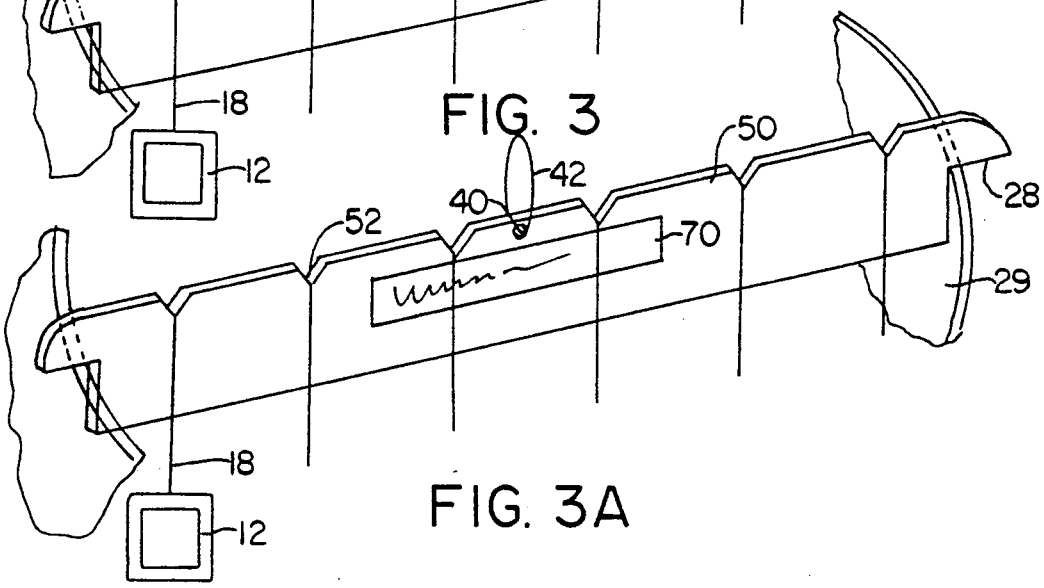
FIG. 3A is a perspective view of an alternative embodiment of the holder for multiple string suspended tea bags, using a notch means on the upper edge of a T-shaped beam to hold the tea bags, and with a logo affixed to either or both faces of the T-shaped beam.

In another embodiment of the holder for multiple string suspended tea bags, FIG. 3, the rod is also replaced with a horizontally placed T-shaped beam 30. A plurality of "V" shaped notches 52 are cut in the upper edge of the beam. The string 18 of the tea bag 12 is placed securely in the notch, such that the tea bags are suspended in hot water for brewing. A suspension means 42 is fitted through a hole 40 in the upper part of the beam.

Figure 4A:
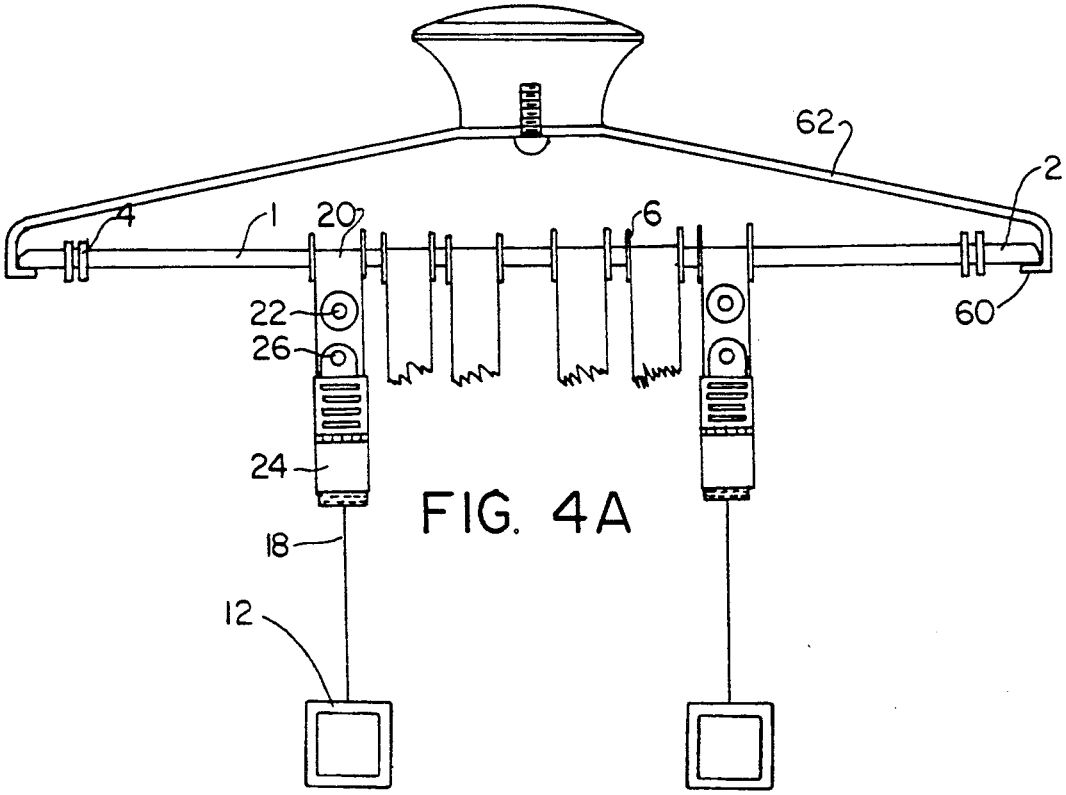
FIG. 4A is a perspective view of an alternative embodiment of the holder for multiple string suspended tea bags, which is the essentially the above preferred embodiment of the invention embedded in the lid of a pot or vessel.
Figure 4B:
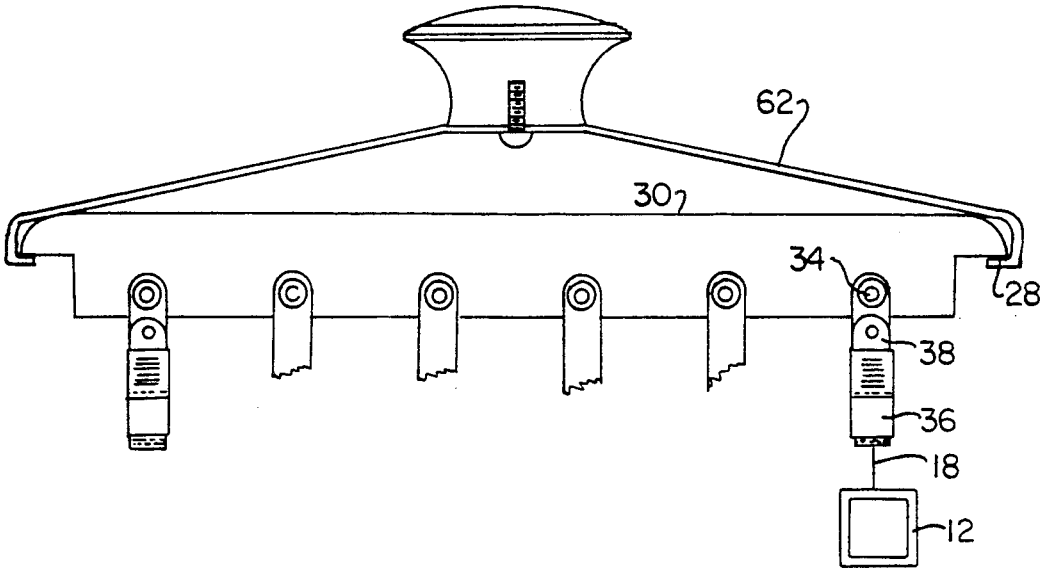
FIG. 4 B is a perspective view of an alternative embodiment of the holder for multiple string suspended tea bags, which is in the form of T-shaped beam, with hanging spring clip means, and is embedded in the lid of a pot or vessel.
FIG. 4C is a perspective view of an alternative embodiment of the holder for multiple string suspended tea bags, which is in the form of T-shaped beam, with hanging spring clip means, and is embedded in the lid of a pot or vessel, and with a logo affixed to either or both faces of the T-shaped beam.
FIG. 4D is a perspective view of an alternative embodiment of the holder for multiple string suspended tea bags, which is in the form of a notched T-shaped beam, embedded in the lid of a pot or vessel.
FIG. 4E is a perspective view of an alternative embodiment of the holder for multiple string suspended tea bags, which is in the form of a notched T-shaped beam, embedded in the lid of a pot or vessel, and with a logo affixed to either or both faces of the T-shaped beam.
Figure 4C:
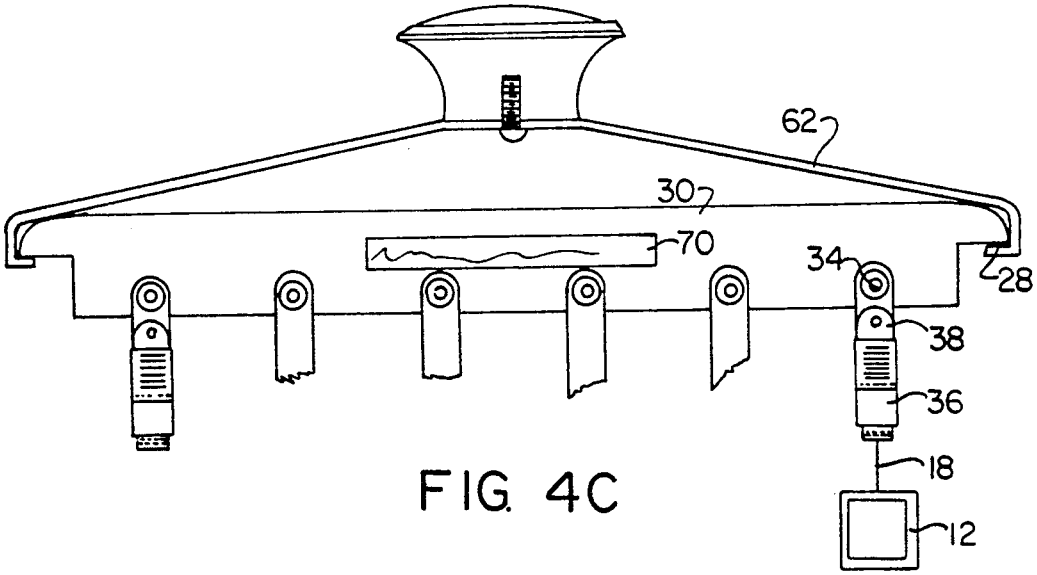
Figure 4D:
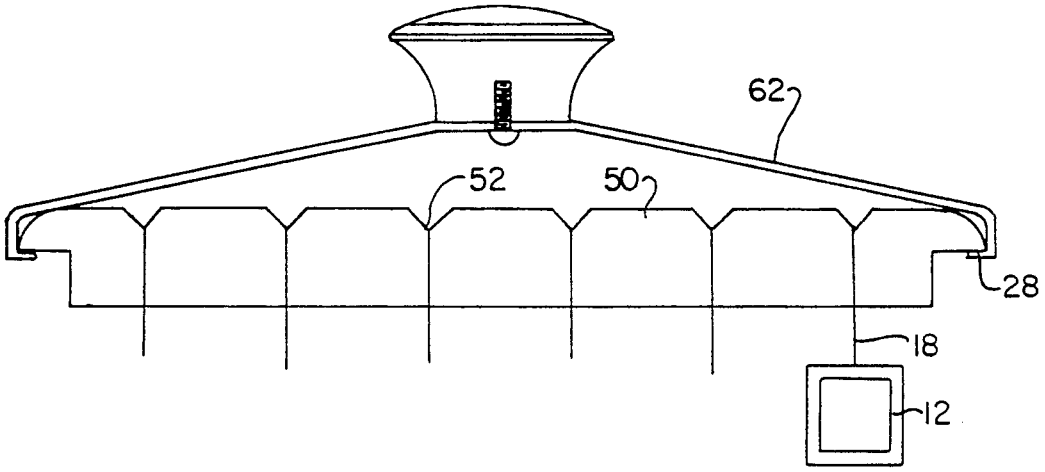
Figure 4E:
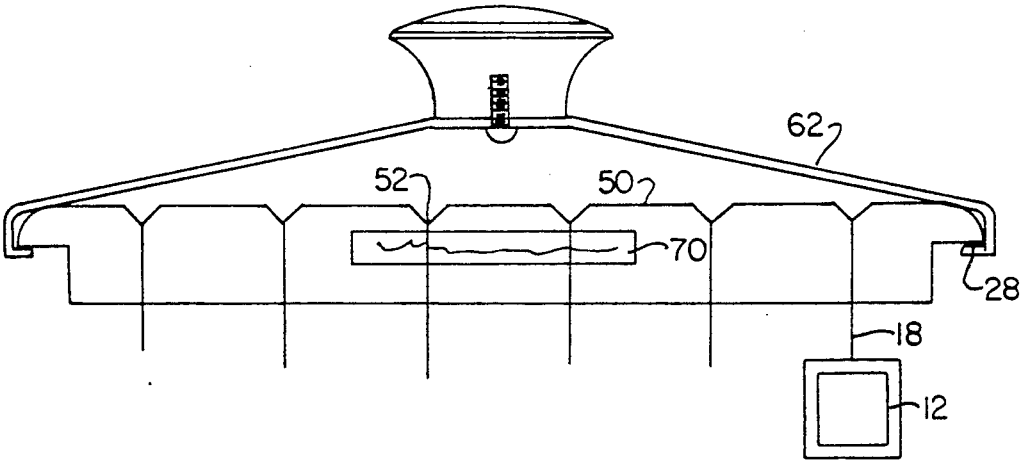

In other embodiments of the holder for multiple string suspended tea bags, FIG. 4A, 4B, and 4D, rather than the tea bag holder resting on the rim of a cup or vessel, the ends of the tea bag holder 60 are affixed at opposite sides of the underneath of a vessel or pot cover 62.

In the embodiments of the holder for multiple string suspended tea bags, FIGS. 2A, 3A, 4C, and 4E, which use the T-shaped beam, an advertising logo 70 can be affixed to either or both faces of the said T-shaped beam.

I claim:

1. A holder for multiple string suspended tea bags, comprising:

a rigid rod;

an end cap encased concentrically over both ends of the said rod;

an end cap holder concentrically over the rod and adjacent to the end caps;

a plurality of tabs vertically hung from the rod and pinch fastened to the said rod;

a spring means to hold the tea bag strings, attached to the lower end of the tabs;

a washer-like spacer concentrically over the rod and astride each tab;

a tubular end spacer concentrically over the rod and between the end spacer and the outer most washer-like spacer;

a centrally placed means to suspend and lift the rod.

2. A holder for multiple string suspended tea bags, comprising:

a T-shaped beam with a front face, a back face, and a top edge a hole being in the center of its front face and through to its back face and a plurality of "V" shaped notches across the top edge such that a tea bag string can be wedged therein;

a suspension means fitted through the hole in the T-shaped beam.

3. The holder for multiple string suspended tea bags as defined in claim 2 in which an advertising log is affixed to either or both sides of the T-shaped beam.

4. A holder for multiple string suspended tea bags, comprising:

a vessel cover;

a T-shaped beam with a front face, a back face, and a top edge, the ends of which are attached at opposite sides of the underneath of the vessel cover, the T-shaped beam having a plurality of notches across the top edge such that a tea bag string can be wedged therein.

5. The holder for multiple string suspended tea bags as defined in claim 4 in which an advertising log is affixed to either or both sides of the T-shaped beam.

* * * * *